US005295845A

United States Patent [19]

Changxing

[11] Patent Number: 5,295,845

[45] Date of Patent: Mar. 22, 1994

[54] COMBINED POWER PLUG

[76] Inventor: Duan Changxing, Agricultural Bank of China Xinyan Sub-Branch, Minquan Road, Xinyang, Henan 464000, China

[21] Appl. No.: 68,838

[22] Filed: May 27, 1993

Related U.S. Application Data

[63] Continuation of Ser. No. 844,458, Mar. 2, 1992, abandoned.

[30] Foreign Application Priority Data

Mar. 2, 1991 [CN] China ..... 91203126.3
Feb. 22, 1992 [CN] China ..... 92101021.4

[51] Int. Cl.[5] ..... H01R 29/00
[52] U.S. Cl. ..... 439/173; 439/171
[58] Field of Search ..... 439/166, 170, 171, 173, 439/174, 175

[56] References Cited

U.S. PATENT DOCUMENTS 2,989,719 6/1961 Aarlaht .

FOREIGN PATENT DOCUMENTS 86207377 9/1987 China .
87207492 10/1987 China .
87202252 12/1987 China .
2054947 7/1989 China .
2051405 1/1990 China .
2055993 4/1990 China .
2060016 8/1990 China .
0085935 8/1983 European Pat. Off. .
328910 10/1919 Fed. Rep. of Germany .
1242986 4/1960 France .
250741 4/1926 United Kingdom .

*Primary Examiner*—Gary F. Paumen

[57] ABSTRACT

A power plug adaptive to various sockets, comprises an insulating plug casing, plug cover, and an adjustment feature. This adjustment feature can include a slot pin hole, an elastic washer, a nut and a washer for accommodating pins and adjusting the relative positions and angles of the pins around the longitudinal axis of each pin. In that manner, different types of sockets can be connected to the power plug. Different types of pins having various shapes, such as a blade or circular shape, can be used with the plug to provide satisfactory contact with the slots of the socket.

11 Claims, 8 Drawing Sheets

COMBINED POWER PLUG

This application is a continuation, of application Ser. No. 07/844,458 filed on Mar. 2, 1992, now abandoned.

The present invention relates to a line connector, and more particularly, relates to a power plug with adjustably positionable pins. These pins can be translationally moved and can be adjusted around their longitudinal axes so that the pins can be adjusted outside the insulating body. The line connection is used in electrical appliances.

DESCRIPTION OF THE BACKGROUND ART

The power plugs and sockets in general use are of various specifications, as shown in FIG. 21. These plugs and sockets have to be used in same-to-same correspondence, while plugs of a certain specification can not be used on sockets of other specifications. This causes tremendous inconvenience. Therefore, there have already been so called "versatile sockets" for sale which combine sockets of several configurations together.

Accordingly, several technical solutions have been proposed for combining two or more plugs and among them, a "versatile plug" has been disclosed by the Chinese Patent 87202252. The object of the plug of this Chinese Patent is to provide a plug pluggable into power sockets of various structures, and the technical solution of which is to exploit the technical feature that the distance between the centers of the two pin holes of the existing power sockets or the two power pins of the existing plugs remains unchanged to design the pins to be rotatable, so that the above mentioned design objective can be realized.

The Chinese Patent 87207492 discloses a multi-usage adjustable power plug", which provides a power plug with adjustable pin distance and changeable flat pins and round pins. The solution is that a plug body is adopted with two round pins mounted on the front end of said body, and two flat pins are sleeved on the round pins with the distance of the pins being adjustable by changing the opening of the body.

The Chinese Patent 89217984.8 discloses a "universal power plug", the object of which is to design a power plug which will fit into either round or square sockets, and into either two or three slots. The technical features of this patent are that all the prongs are designed in double bevelling cylindrical shape, wherein the grounding prong can be folded back and hidden.

However, the specification of the plug and socket is determined by the number and shape of their pins and slots as well as the distance and angle between the pins or the slots. Many different plugs and sockets can be formed by the permutations and combinations of the four factors, i.e., number, shape, distance and angle. The insufficiency of the above mentioned patented techniques lie in that they have not taken into consideration all the variations of said four factors, and in fact, the distances between the hot line slot and the neutral line slot for different sockets are not all the same, the adjustment range of the distance between the pins adjusted by the size of the opening of the pin body is rather restricted, and it can not satisfy the requirement of close parallel contact of the pin prong with the slot terminals, which is subject to unsatisfactory contact or even damages.

SUMMARY OF THE INVENTION

Therefore, the object of the present invention is to prevent the drawbacks of the prior art and provide a power plug capable of adjusting the relative positions and angles of the pin axes. One of such plugs can be conveniently inserted into several different power sockets while ensuring satisfactory contact between the pin prong and the slot terminals.

A further object of the present invention is to provide a power plug, comprising an insulating body with a first insulator portion and a second insulator portion, at least one pin with a contact head, a screw bar and shoulder therebetween and at least one elastic washer and nut. At least one long-shaped through-hole or section of through-holes is formed in the first insulator portion and the pin is placed in the through-hole via the elastic washer and nut. The position of the pin and the angle of the pin around its axis are regulatable outside of the insulating body.

Another object of the present invention is to provide a power plug, which comprises an insulating body having a first insulator portion and a second insulator portion, and the pins. The plug is characterized in that the first insulator portion and the conducting wire are fabricated integrally.

Yet another object of the present invention is to provide a power plug with at least one means for accommodating pins on the insulating body. The accommodating means is a chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings which are given by way of illustration only, and thus are not limitative of the present invention and wherein:

FIGS. 12, 13, 14 and 15 are schematic diagrams showing four types of shapes of the slot holes 12*a* provided in the cover 2 of the plug with the solid lines representing the horizontal longitudinal axes of the slot hole;

FIGS. 16, 17, 18 and 19 are schematic diagrams showing the distribution of the pin holes 12*a* provided in the cover 2 of the plug, wherein the holes are shown in but not restricted to circular shape (because any other shape can be employed), and the other solid lines represent the lines connecting the centers of the holes, the run of the distribution of the holes constitutes a section;

DETAILED DESCRIPTION OF THE PREFERRED EMBODIMENTS

Figure 1:
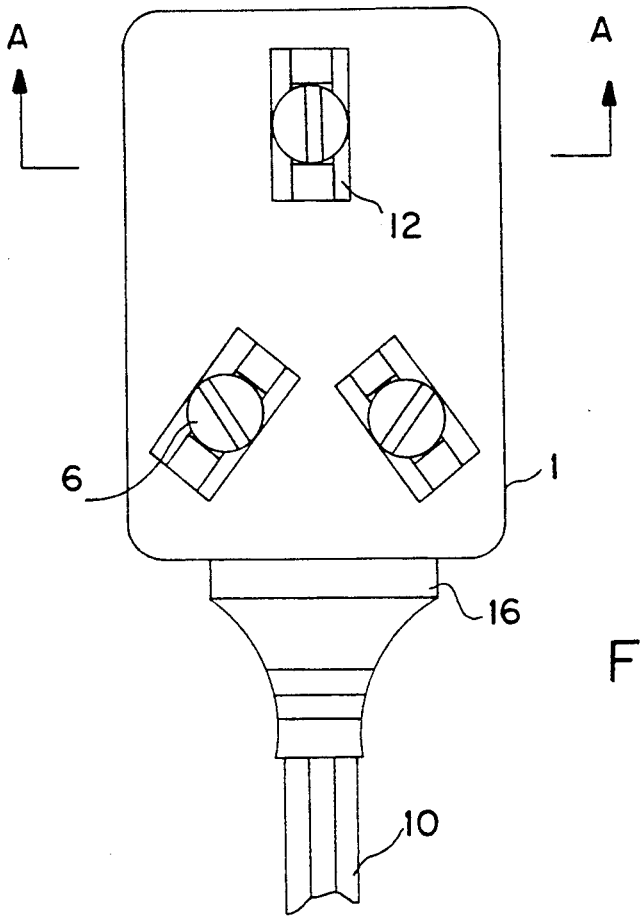
FIG. 1 is a top view of the power plug according to the present invention.

Like reference numerals are represented by like parts throughout the drawings. Turning now to FIG. 1, a power plug for the instant invention is shown.

This power plug is for an electrical appliance and comprises an insulated body 1, pin 6 consisting of contact 3 and bolt 5, and is characterized in that at least one means 12 is provided for holding the pin 6. The relative positions and angles of the axes of the pins are adjustable on the surface of the insulated body 1.

Figure 4:
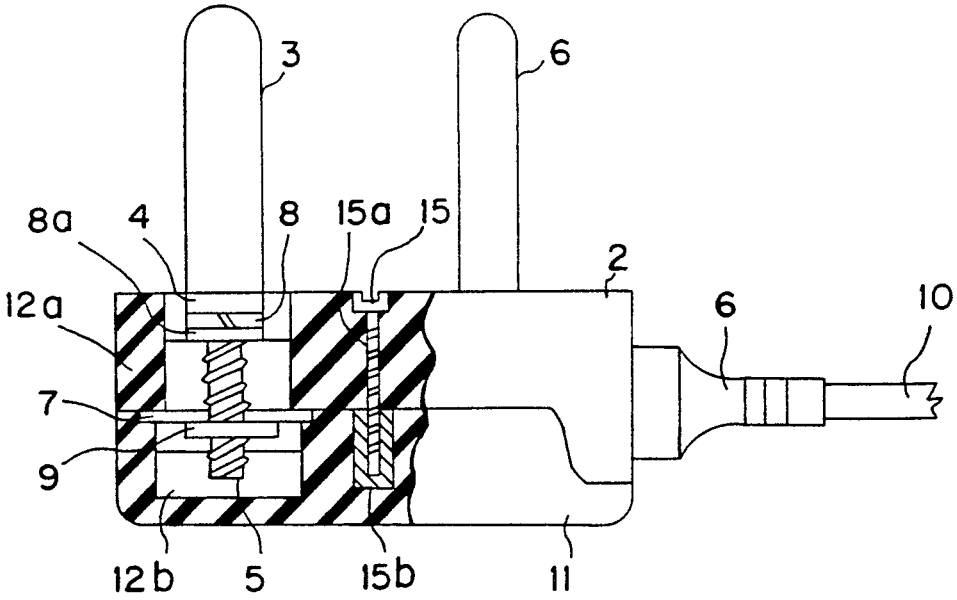
FIG. 4 is a partial sectional view of the power plug shown in FIG. 3.

The insulated body I has a conducting wire 10 integrally formed therewith. The means 12 consists of slot hole 12*a*, associated slot chamber 12*b* provided under said pin hole, slidable nut 9 accommodated in the slot chamber 12*b*, and conductor 7 connected to said conducting wire provided along the whole contacting surface of said slot chamber 12*b* as shown in FIG. 4. The pin 6 is adjustably mounted on the surface of said insulated body 1 by its connecting to the nut 9 through an elastic washer 8 and washer 8*a* and has a satisfactory electric contact with the conductor 7.

Figure 8:
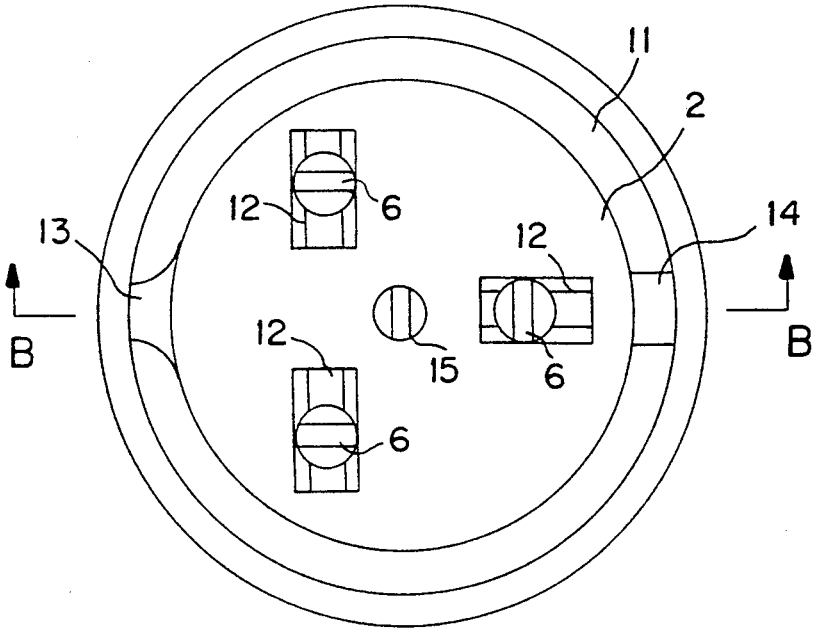
FIG. 8 is a top view showing the another embodiment of the power plug according to the present invention.

Another embodiment for the power plug is used in appliances and is shown in FIG. 8. This embodiment comprises a plug casing 11, plug cover 2, pin 6 binding screw 15 for binding said casing and cover, elastic washer 8, nut 9, line inlet 13, and grounding line hole 14. The pin has a contact 3, shoulder 4 and screw bolt 5. A means 12 is provided on the cover 2 of the plug, for adjusting the relative positions and angles of the pins around their axes.

The power plug according to the present invention is characterized in that there are three staged slot holes 12*a* provided in the cover 2 of the plug, or three pin hole sections are distributed on the cover 2 of the plug. Each of the sections consists of several intermittent pin holes 12*a*.

As shown in FIGS. 12–19, at least eight types of arrangement of the pin hole 12*a* are provided in the cover 2 of the power plug, i.e. the " " shape, " " shape, " " shape and arch shape of the horizontal longitudinal axes of the slot receptacles 12 of the hot line and neutral line, or the " " shape, " " shape, " " shape and arch shape of the connecting line of the centers of the holes for the pins in the pin hole sections for the hot line and neutral line.

The various embodiments of the present invention will now be described in more detail with reference to the accompanying drawings.

Figure 2:
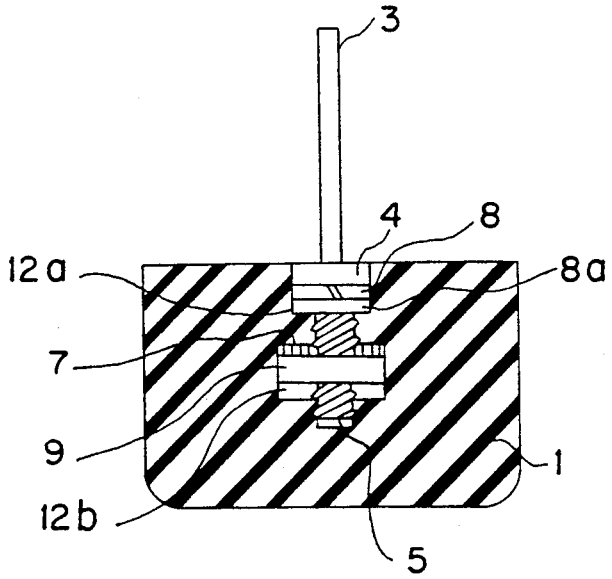
FIG. 2 is a partial sectional view taken along line A—A of FIG. 1.

FIGS. 1 and 2 show a preferred embodiment of the plug according to the present invention, the plug consists of an insulated body 1 formed integrally with conducting wire 10, and three pins 6 having contacts 3 at their upper ends and bolt 5 at their lower ends.

As shown in the drawings, three means 12 for adjusting the pins 6 are provided on one surface of the insulating body 1, each of the means consists of a long pin hole 12*a* and a slot chamber 12*b* formed under the pin hole 12*a*. The long pin hole 12*a* can be a slot through-hole having the same width of its upper opening and lower opening, however, it is preferable for the pin hole 12*a* to have a wider upper opening and narrower lower opening and staged longitudinal inner walls, as shown in FIG. 2. The length of the slot chamber 12*b* is greater than or equal to the length of the long pin hole 12*a*, and the width of the slot chamber 12*b* is greater than the minimum width of the pin hole 12*a*. Conductive or metallic nut 9 is provided inside the slot chamber 12*b*. The nut 9 can be of various shapes, however, it is preferable for the nut to be slidable translationally along and inside the slot chamber 12*b* but unrotatable thereabout, such as square or other polygonal nuts.

A conductor 7 equal to or greater than the length of the pin hole 12*a* is provided in the periphery of the lower surface of the pin hole 12*a* or on the whole connecting surface of the pin hole 12*a* and the slot chamber 12*b*. The conductor 7 is electrically connected with the conducting wire 10.

The upper end of pin 6 is the contact 3, which can be of various shapes, such as a blade, pole, etc. The lower end of pin 6 has the bolt 5 simultaneously used as a terminal. A shoulder 4 can be provided between the contact 3 and bolt 5, as shown in FIG. 2. The pin 6 is fixed on the insulated body 1 through an elastic washer 8 and washer 8*a*, and connected to the conducting wire 10 through conductor 7.

Such structure of the present invention permits the pin 6 to be translationally adjustable within the longitudinal range of the pin hole 12*a*, and also rotationally adjustable about its longitudinal axis by an angle within a range of 360° in the horizontal plane perpendicular to its longitudinal axis. The pins on the insulated body can be optionally changed and assembled according to configuration requirements of various shaped sockets.

Figure 7:
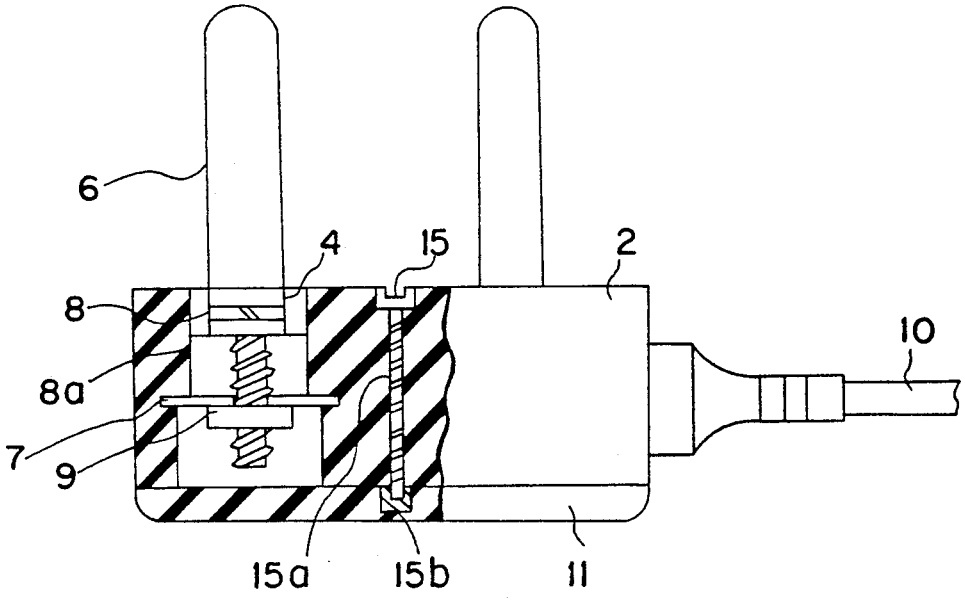
FIG. 7 is yet another type of the power plug of FIG. 3.

FIG. 7 shows another modification of the preferred embodiment, wherein, the pin holes 12*a* in the first insulator of a plug cover 2 are long slots with a wider width at two ends and narrower width at the intermediate portion, thereby projections are formed on the two longitudinal side inner walls thereof. The pitch between the projections, i.e. the narrowest portion of the pin hole 12*a* only allows the bolt 5 to pass through. The pins 6 are bound to nuts 9 through elastic washers 8 and washers 8*a*, and are adjustably fixed on the plug cover 2. The plug casing 11 as the second insulator is of a planar shape and looks like a cover.

Figure 3:
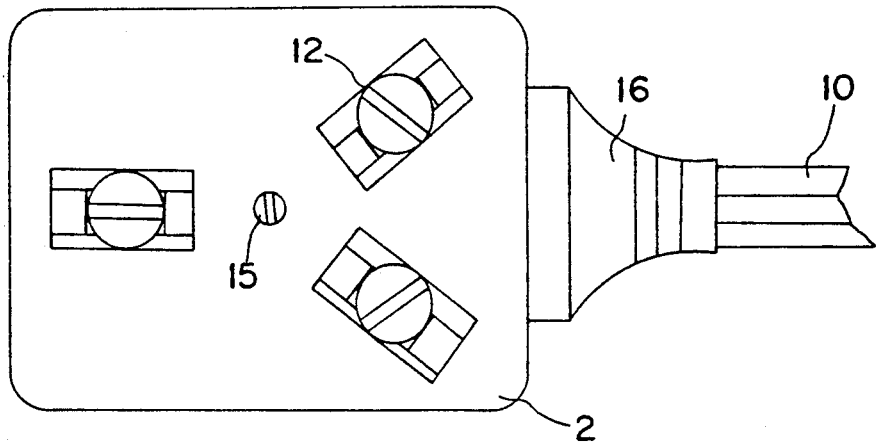
FIG. 3 is a top view of the power plug according to a preferred embodiment of the present invention.

FIG. 3 is a top view showing another embodiment of the power plug according to the present invention. The power plug comprises an insulating body 1 having a plug casing cover 2, plug casing 11, pin 6, conducting wire 10 and a screw bolt 15. The pin 6 has a contact 3, shoulder 4 and bolt 5.

The plug cover 2 is substantially a flat rectangular parallelepiped shape, as shown in FIGS. 3 and 4. The surface of plug cover 2 has three long pin holes 12*a* and a bolt hole 15*a*. The bolt hole 15*a* is centrally located in the plug cover 2 and the three pin holes 12*a* are in a triangular distribution. Stages are formed on the two longitudinal side inner walls of each of the pin holes 12*a*, so that the pin holes 12*a* have a long slot having a wider upper opening and a narrower lower opening. The upper widths of the pin holes 12*a* are suitable for the elastic washer 8 and the washer 8*a* to pass through, while the lower widths allow the bolt 5 of the pin 6 to only pass through.

Sheet conductors 7 intimately connected with the inner surface of the plug cover 2 are provided in the periphery of each of the slot pin holes 12*a* as shown in FIGS. 4. The conductors 7 are connected to the conducting wires 10. The whole plug cover 2 comprising pin holes 12*a*, conductors 7 and conducting wires 10 is integrally formed. A protective reinforced portion 16 is formed at the connection portion of the plug cover 2 with the conducting wires 10.

The plug casing 11 is a housing cooperating with the plug cover 2 and having the similar corresponding rectangular parallelepiped shape with the plug cover 2. As shown in FIG. 4, three concave bottom slots 12*b* and a screw hole 15*b* are formed in the inner surface of the plug casing 11 with the screw hole 15*b* corresponding to the bolt hole 15*a* in the plug cover 2 and the three concave slots 12*b* corresponding to the three pin holes 12*a* in the plug cover 2, respectively. The width of each of the concave slots 12*b* is greater than the minimum width of its corresponding pin hole 12*a*, while the length of the concave slot 12*b* may be greater than or equal to that of the pin hole 12*a*.

Each of the concave slots 12*b* has an upper portion and a lower portion having the same length. The width of the upper portion is wider than that of the lower portion, thereby, two stages are formed longitudinally extending along the two sides of the concave slot, so as to form a narrower concave slot between the stages. The upper portion of each concave slot 12*b* can accommodate a quadrilateral or other polygonal nut 9. The nut 9 can translationally slide in the concave slot 12*b* but can not rotate by an angle of 90° therein. The narrower concave slot of the lower portion of each of the concave slots 12*b* can only accommodate translational sliding of bolt 5 of pin 6. A concave portion cooperating with the reinforced portion 16 is formed at a location of the inner surface of the plug casing 11 corresponding to the connecting portion of the plug cover 2 with the conducting wires 10.

Figure 5:
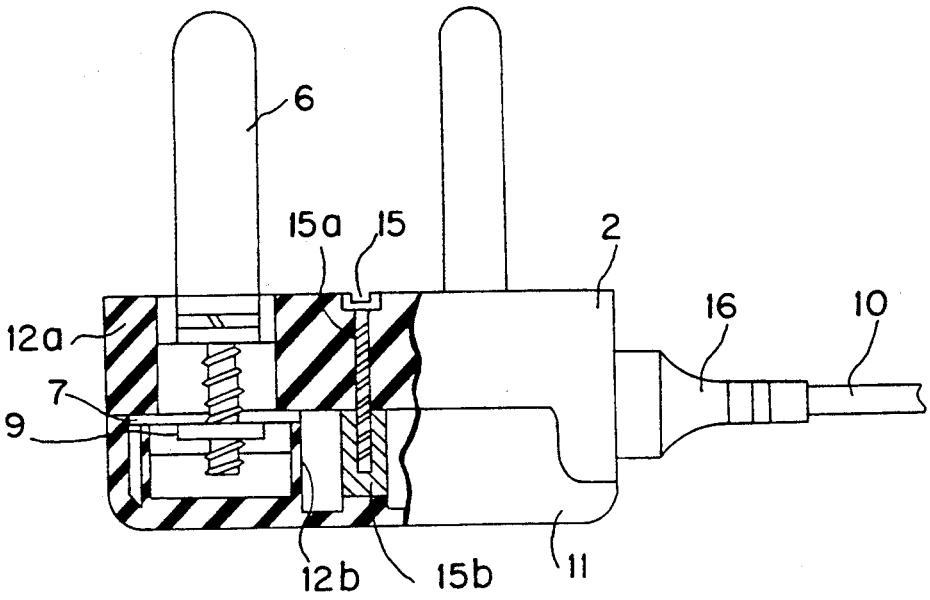
FIG. 5 is a partial sectional view showing another structure of the power plug of FIG. 3.

Referring to FIG. 5, another form of the plug casing 11 consists of walls and substrate. On the inner surface of the substrate, there are three projected concave slots 12*b* and a projected screw hole 15*b* formed integrally with the substrate and corresponding to the three pin holes 12*a* and bolt hole 15*a* in the plug cover 2, respectively. The structure of the inner projected concave slot 12*b* is the same as that of the aforementioned concave slot 12*b*, which will not be described in detail herein.

As shown in FIG. 3, the plug cover 2 and plug casing 11 are bound together by the bolt 15. The pin 6 is connected to the nut 9 in the concave slot 12*b* through the elastic washer 8, washer 8*a* and pin hole 12*a*, thereby being adjustably fixed on the surface of the insulating body 1. At the same time, different shaped pins 6 can be changed as needed.

In addition, there is another modification in this preferred embodiment according to the present invention, i.e., means for accommodating spare pins of various shapes is provided on the aforementioned insulating plug body 1.

Figure 6:
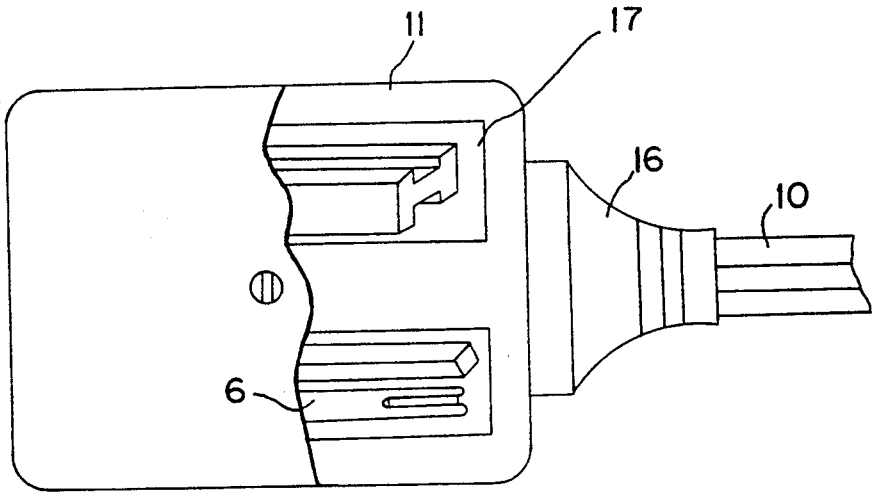
FIG. 6 is another type of the power plug of FIG. 3.

Specifically, one or more cavities of appropriate depth and a center screw hole are provided on the surface of the aforementioned plug casing 11 directly opposite to the pin 6 or the exterior surface of the substrate of the plug casing, and an insulating cover having a corresponding bolt hole is added, which is called the back cover of the plug casing. This cover is intimately bound to the plug casing by the screw 15 to form a chamber 17 for accommodating the spare pins to receive one or more pins of various shapes, as shown in FIG. 6. Thus, the insulating plug body consists of three main portions: a plug cover connected to the conducting wires, a plug casing and a back cover of the plug casing, with each of the three portions being fabricated integrally.

The aforementioned means 17 for accommodating the spare pins 6 on the plug casing can be various chambers, and the cover of which can also be in different forms, such as a side cover, partial cover and the like. Attachment of the cover with the plug casing 11 can also be of different forms, such as pivot binding, push-and-pull binding (guideway and guide rail), holding key binding and the like. The particular attachment arrangement can be selected according to the needed requirements.

Figure 9:
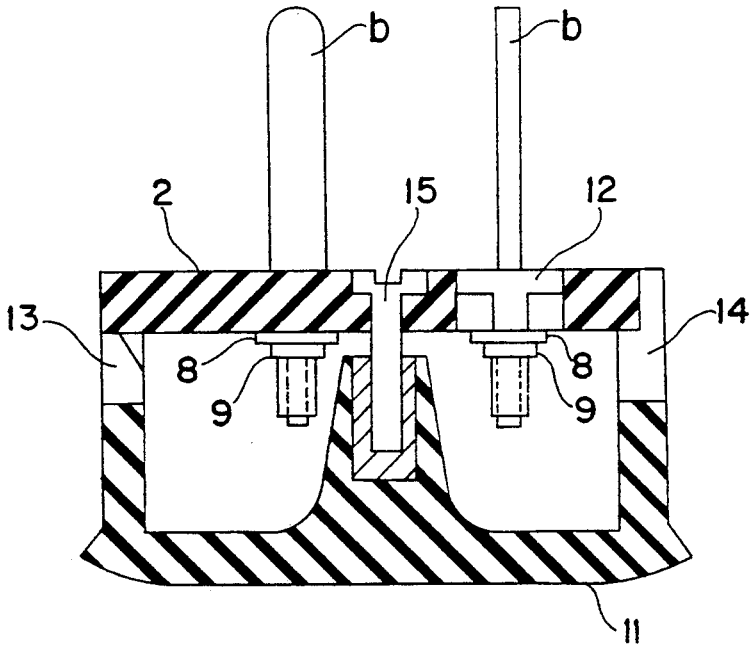
FIG. 9 is a sectional view taken along line B—B of the power plug shown in FIG. 8.
Figure 12:
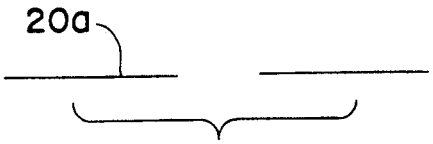
FIGS. 12 through 19 show the distributions of the pin holes for the hot line and the neutral line.
Figure 16:
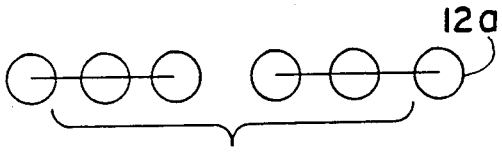
Figure 13:
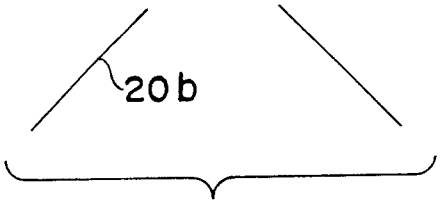
Figure 17:
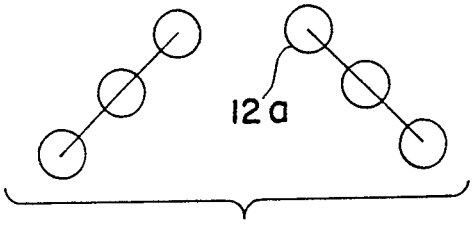
Figure 14:
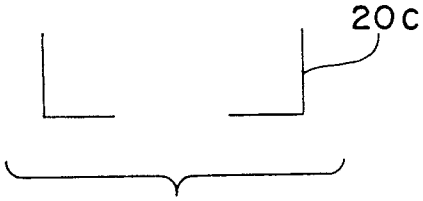
Figure 18:
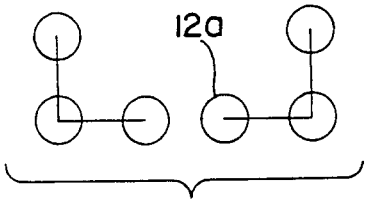
Figure 15:
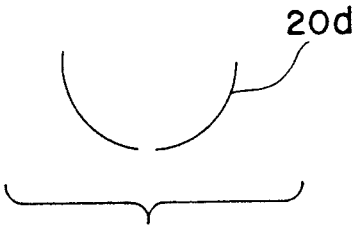
Figure 19:
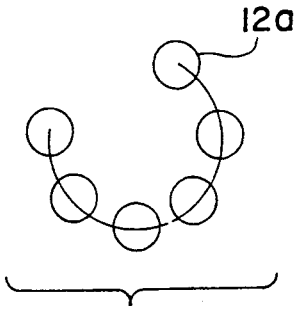

In another embodiment as shown in FIGS. 8 and 9, the power plug according to the present invention comprises a plug casing 11, a line inlet 13 provided in the wall of the casing, a grounding line hole 14 symmetrical with the line inlet, a plug cover 2 attached to the casing 11 through a screw 15, three pin holes 12*a* provided in the cover of the plug, and pins 6 fixed in the pin holes through elastic washers 8 and nuts 9.

In this embodiment, the plug casing 11 can be of any shape. The casing 11 is shown as being circular in the drawings. The pin holes 12*a* provided in the cover 2 of the plug are three rectangular slots, which are symmetrically distributed about the center of the cover. The connecting line of the horizontal longitudinal axes appears in "⊥" or "T" shape, the two slots parallel to the horizontal longitudinal axis are used for the pins of the hot line and the neutral line respectively. There is a holder or stage formed along the longitudinal direction of the lower portion of each of the rectangular slots, thus, each of the pin holes 12*a* is of the shape of a larger upper portion and a smaller lower portion with a shoulder therein.

Figure 11:
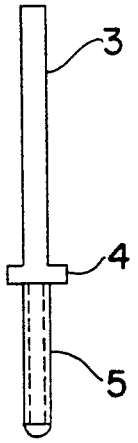
FIG. 11 is a side view of the pin 6 of FIG. 10.
Figure 10:
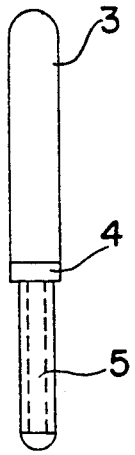
FIG. 10 is a front view of the pin 6 shown in FIGS. 8 and 9.

As shown in FIGS. 10 and 11, the pin 6 includes a contact 3, shoulder 4 and bolt 5. The contact 3 is a flat quadrangular shape with a rectangular shape in front view. The upper end of contact 3 is arched as seen in FIG. 10. The length and width of contact 3 are adaptive to the shapes of both circular and rectangular socket receptacles to guarantee satisfactory contact. The shoulder 4 is of a circular shape for cooperating with the shoulder inside the receptacle 12 to support the pin 6. The diameter of the shoulder 4 is coordinated with the width of the shoulder of the pin receptacle to accommodate translation and rotation movement of the pin 6. The diameter of the terminal 5 is coordinated with the width of the pin receptacle 12 to accommodate rotation of the pin 6.

As shown in FIGS. 12, 13, 14 and 15, f our types of arrangement patterns of the pin slot hole 12 are provided. The figures show the horizontal axes of the pin holes for the hot line and the neutral line. Their positions on the plug cover 2 should be close to the side of the line inlet 13. The two "—" shapes 20*a* can be interconnected, and the "/\" shape 20*b*, "L" shape 20*c* and arch shape 20*d* are not restricted by those shown in the drawings. For example, these shapes can be inverted images thereof.

Figure 20:
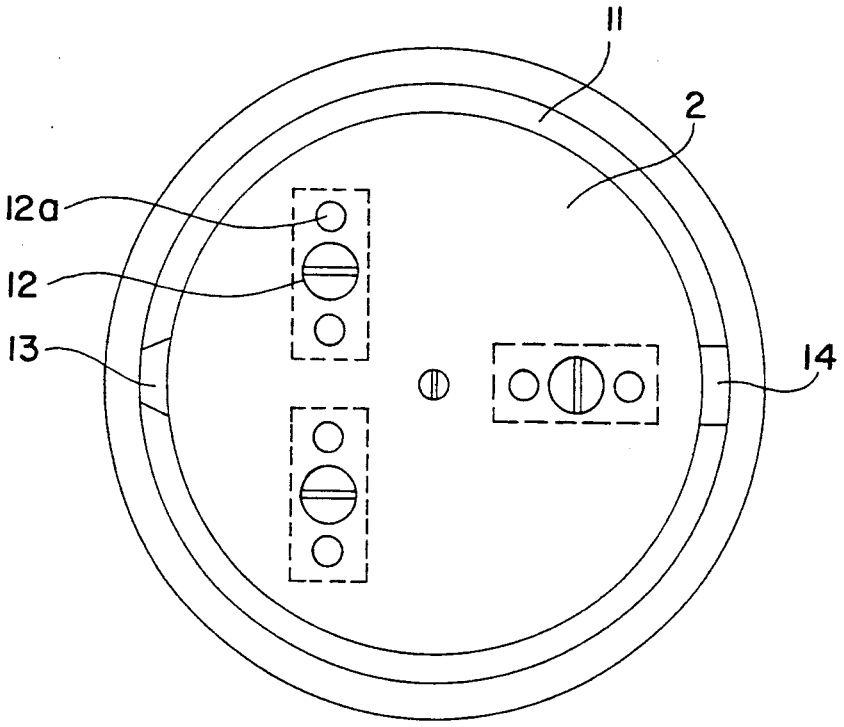
FIG. 20 shows a top view of yet another embodiment of the power plug according to the present invention.
Figure 21:
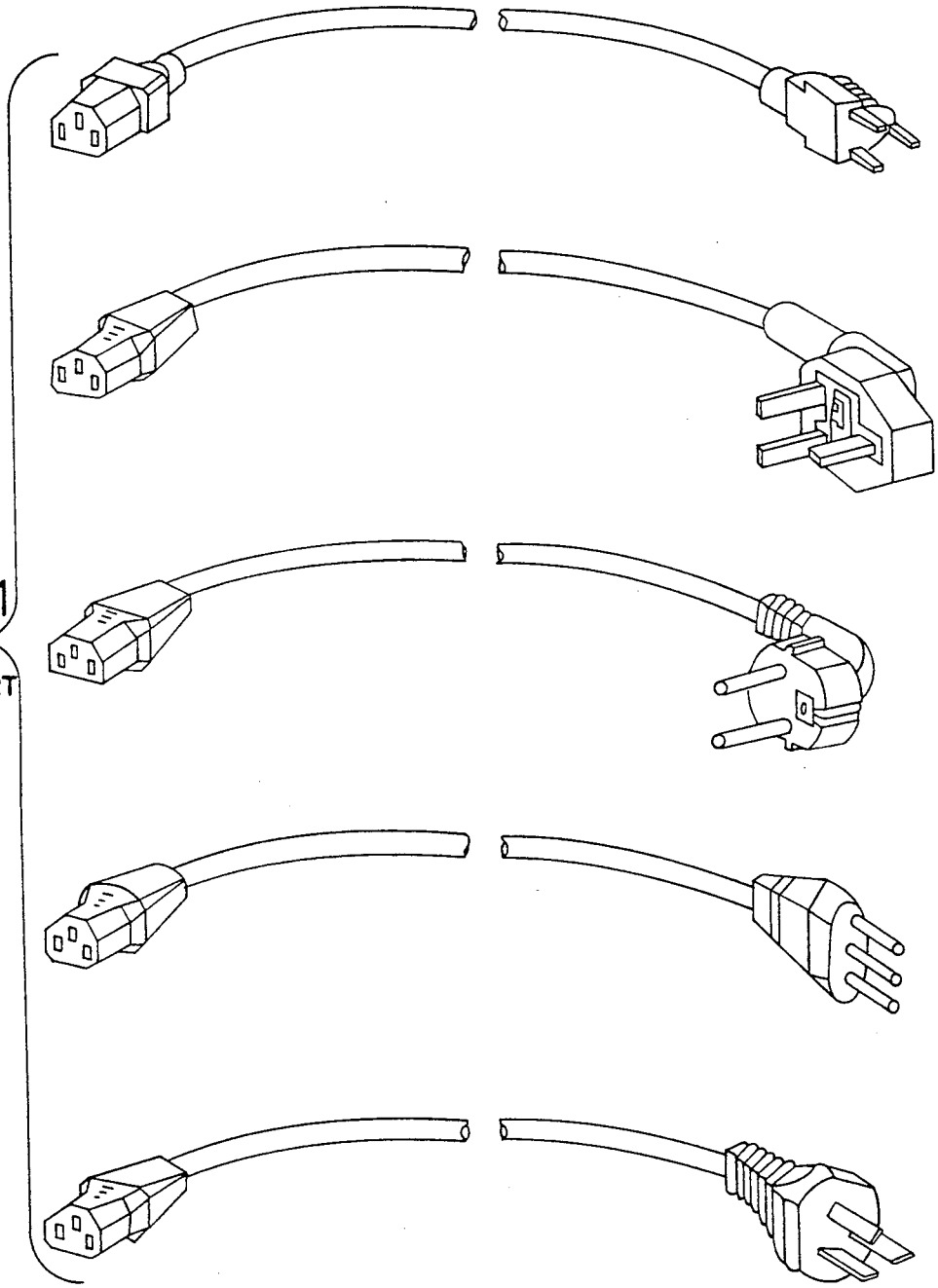
FIG.21 PRIOR ART
FIG. 21 shows several prior art plugs and sockets.

Another embodiment of the present invention is shown in FIG. 20. This embodiment comprises the same basic elements of the embodiment mentioned above, except that three pin hole sections 12 are distributed symmetrically about the center of the plug cover 2 to form a "⊥" shape. Each of the pin hole sections 12 consists of several pin holes 12*a*. For example, three pin holes 12*a* can be provided as shown in the drawings. Each of the pin holes 12*a* may have a shoulder or the shoulder can be omitted as required. The pins 6 can be set in three of those holes as required.

There are various modifications of the arrangement of the pin hole sections 12. The arrangement patterns of the pin hole sections for the hot line and neutral line are shown in FIGS. 16, 17, 18 and 19, wherein, the circles represent the pin hole 12*a*. The number of holes is not restricted by those shown in the drawings. The runs of the connecting lines are the same as those shown in FIGS. 12, 13, 14 and 15.

The advantage of the present invention lies in that the relative positions of the axes of the pins are adjustable by means of providing pin holes capable of translating and rotating. The plug can therefore be inserted into sockets of various configurations.

By using the power plug of the present invention, the distance and angle between the pins for the hot line and the neutral line can be adjusted according to the shape, distance and angle of the slot of the power socket through adjustment of distance by translation and adjustment of angle by rotation (especially when the blade receptacles are configured in a "  " pattern) . The distances between the grounding line and the hot line and the neutral line can be adjusted as well through the translation of the grounding pin.

The shape of the pins of the present invention is only an example, and corresponding adaptive parts can be produced according to economic requirements as well as the variations in the shape of the slots of the socket, for example the emergence of square socket slots. The position of the grounding line is not restricted to those defined by the drawings of the present invention. For example, the hot line, neutral line and the grounding line could be arranged on the same straight line. All of those cases can be resolved by the technical spirit of the present invention.

The present invention has been described in detail by way of examples, however, the present invention is not restricted by the forms shown in the above embodiments and drawings. Various modifications and improvements can be made by the ordinary persons in the art according to the spirit and principles of the present invention, and these modifications and improvements are considered to be within the scope of the claims of the present invention.

I claim:

1. A power plug, comprising:

an insulating body having a first insulator portion and a second insulator portion, the first insulator portion has at least one slot formed therein;

at least one pin with a contact head, a screw bar and a shoulder, the shoulder being between the contact head and the screw bar, each of the at least one slots in the first insulator portion having a respective one of the pins therein; and means for adjusting positioning of each pin relative to the insulating body and for adjusting rotational position of each pin about a longitudinal axis of each pin, each of the pins being slidable along its respective slot in which the is located to thereby vary the distance between the and an outer edge of the insulating body, the means for adjusting comprises at least one nut and elastic washer attached to the corresponding pin.

2. The power plug according to claim 1, further comprising a conductor means and a wire, the conductor means connecting the wire to at least one of the pins, the conductor means being provided around each slot in an inner surface of the first insulator portion.

3. The power plug according to claim 1, wherein said at least one elastic washer is a first washer and wherein the means for adjusting further comprises a second washer for each pin, a respective first washer, a respective second washer and a respective nut being received in each slot with the at least one pin.

4. The power plug according to claim 2, wherein each slot has respective stage formed therein.

5. The power plug according to claim 1, further comprising a wire integrally fabricated with the first insulator portion.

6. The power plug according to claim 2, further comprising a wire integrally fabricated with the first insulator portion.

7. The power plug according to claim 1, further comprising at least one bottom portion formed along each slot, each bottom portion facing the first insulator portion.

8. The power plug according to claim 1, wherein said first insulator portion and said second insulator portion are bound together by connection means, the connection means being one of a bolt connection, a guide rail connection or a guide way connection.

9. The power plug according to claim 1, further comprising a wire, the wire, the first insulator portion and the second insulator portion being integrally fabricated.

10. The power plug according to claim 7, further comprising a wire, the wire, the first insulator portion and the second insulator portion being integrally fabricated.

11. The power plug according to claim 1, further comprising at least one chamber for accommodating spare pins, the at least one chamber being provided on said insulating body.

* * * * *